US009626863B2

(12) United States Patent
Wu et al.

(10) Patent No.: US 9,626,863 B2
(45) Date of Patent: Apr. 18, 2017

(54) INTERMEDIATE COMPUTING DEVICE THAT USES NEAR-FIELD ACOUSTIC SIGNALS TO CONFIGURE AN END USER DEVICE

(71) Applicants: RAKUTEN KOBO INC., Toronto (CA); RAKUTEN INC., Shinagawa-ku (JP)

(72) Inventors: James Wu, Newmarket (CA); Yasuyuki Hayashi, Tokyo (JP)

(73) Assignees: RAKUTEN KOBO INC., Toronto (CA); RAKUTEN INC., Shinagawa-ku (JP)

( * ) Notice: Subject to any disclaimer, the term of this patent is extended or adjusted under 35 U.S.C. 154(b) by 541 days.

(21) Appl. No.: 14/066,444

(22) Filed: Oct. 29, 2013

(65) Prior Publication Data

US 2015/0117159 A1 Apr. 30, 2015

(51) Int. Cl.
*G08C 23/02* (2006.01)

(52) U.S. Cl.
CPC ..... *G08C 23/02* (2013.01)

(58) Field of Classification Search
CPC ..... H04L 67/125; H04W 12/06; H04R 5/04; H04R 2499/11; H04R 2420/07; G06F 13/10; H04B 11/00
See application file for complete search history.

(56) References Cited

U.S. PATENT DOCUMENTS 6,737,957 B1 * 5/2004 Petrovic ..... G10L 19/018 340/5.86
7,334,735 B1 * 2/2008 Antebi ..... G01S 5/22 235/492
8,791,789 B2 * 7/2014 Petrovic ..... G10L 19/018 340/12.5
9,032,131 B2 * 5/2015 Poulsen ..... G06F 3/162 710/305
9,380,059 B2 * 6/2016 Aslund ..... H04L 63/0492
2004/0137929 A1 * 7/2004 Jones ..... H04N 21/6582 455/517
2007/0067833 A1 * 3/2007 Colnot ..... H04L 9/3271 726/9
2008/0141313 A1 * 6/2008 Kato ..... H04N 7/1675 725/62
2008/0209056 A1 * 8/2008 Choi ..... H04L 63/0815 709/229
2010/0046553 A1 * 2/2010 Daigle ..... G06F 21/35 370/474
2010/0067403 A1 * 3/2010 Clayton ..... H04L 41/0846 370/254
2010/0110837 A1 * 5/2010 Jung ..... H04B 11/00 367/137
2011/0270764 A1 * 11/2011 Mizani Oskui ..... G06Q 20/325 705/75

(Continued)

*Primary Examiner* — An T Nguyen
(74) *Attorney, Agent, or Firm* — Oblon, McClelland, Maier & Neustadt, L.L.P.

(57) ABSTRACT

An intermediate device is operated to play back an acoustic configuration file for an end-user device. The acoustic configuration file can embed configuration parameters that are detectable by the end-user device. In particular, the end-user device can use the configuration parameters in conjunction with performing select operations, such as operations to configure the end-user device for communication with the network service.

23 Claims, 6 Drawing Sheets

(56) References Cited

U.S. PATENT DOCUMENTS

| | | | | |
|---|---|---|---|---|
| 2012/0179525 | A1* | 7/2012 | Seguin | G06Q 30/0207 705/14.16 |
| 2012/0214416 | A1* | 8/2012 | Kent | H04L 63/18 455/41.2 |
| 2012/0290689 | A1* | 11/2012 | Beguelin | H04L 67/125 709/220 |
| 2013/0073748 | A1* | 3/2013 | Masuda | H04R 27/00 710/15 |
| 2013/0122982 | A1* | 5/2013 | Laor | G06F 13/10 463/16 |
| 2013/0279699 | A1* | 10/2013 | Suzuki | H04R 5/04 381/2 |
| 2014/0006483 | A1* | 1/2014 | Garmark | H04L 67/42 709/203 |
| 2014/0040189 | A1* | 2/2014 | Cuttner | G06F 17/30796 707/610 |
| 2014/0146192 | A1* | 5/2014 | Zhou | H04N 5/23203 348/211.2 |
| 2015/0106887 | A1* | 4/2015 | Aslund | H04L 63/0492 726/5 |
| 2015/0117158 | A1* | 4/2015 | Wu | G08C 23/02 367/197 |
| 2015/0117159 | A1* | 4/2015 | Wu | G08C 23/02 367/197 |

* cited by examiner

INTERMEDIATE COMPUTING DEVICE THAT USES NEAR-FIELD ACOUSTIC SIGNALS TO CONFIGURE AN END USER DEVICE

TECHNICAL FIELD

Examples described herein relate generally to an intermediate computing device that uses near-field acoustic signals to configure an end-user device.

BACKGROUND

There exists numerous kinds of consumer devices that can receive services and resources from a network service. Such devices can operate applications or provide other functionality that links the device to a particular account of a specific service. For example, e-reader devices typically link to an online bookstore, and media playback devices often include applications which enable the user to access an online media library. In this context, the user accounts can enable the user to receive the full benefit and functionality of the device.

DETAILED DESCRIPTION

Figure 1:
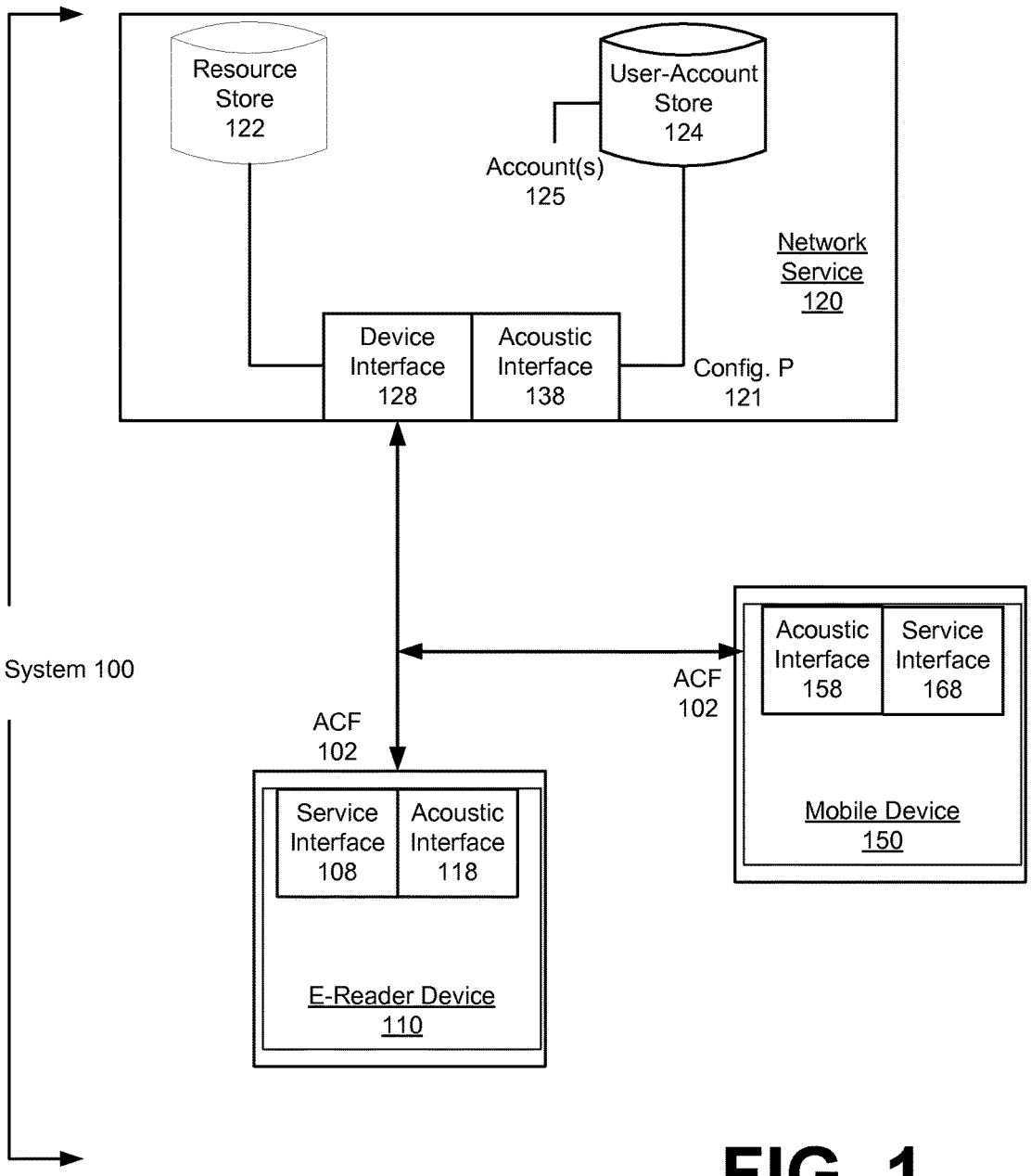
FIG. 1 illustrates a system in which an end-user device is configured to access a network service through the use of a near-field acoustic signal, according to an embodiment.

According to embodiments described herein, an intermediate device is operated to play back an acoustic configuration file for an end-user device. The acoustic configuration file can embed configuration parameters that are detectable by the end-user device. In particular, the end-user device can use the configuration parameters in conjunction with performing select operations, such as operations to configure the end-user device for communication with the network service.

In an embodiment, an intermediate device determines a set of configuration parameters based on information determined by the intermediate device. The intermediate device generates at least a portion of an acoustic configuration file that embeds the configuration parameters. Additionally, the intermediate device plays back the acoustic configuration file to generate an acoustic signal that conveys the configuration parameters to the end-user device.

According to some embodiments, the acoustic configuration file includes content. In one implementation, the content of the audio configuration file includes music. In a variation, the audio configuration file includes voice, such as a message from a source (e.g., network service) directing instructions or other notification. Still further, in some variations, the audio output from the acoustic configuration file is provided within an in-audio frequency (10 Hz<fs<22.05 kHz). In other variations, the audio output from the acoustic configuration file is provided in an out-of-band frequency range (100 kHz>fs>22.05 kHz).

In still another embodiment, an intermediate device receives a first acoustic configuration file from a network service. The first acoustic configuration file can include a first set of configuration parameters. The intermediate device can also determine a second set of configuration parameters, using, for example, local resources of the mobile computing device. The intermediate device can generate a second acoustic configuration file that includes the first acoustic configuration file. The second acoustic configuration file can include the first of configuration parameters as well as the second set of configuration parameters.

One or more embodiments described herein provide that methods, techniques and actions performed by a computing device are performed programmatically, or as a computer-implemented method. Programmatically means through the use of code, or computer-executable instructions. A programmatically performed step may or may not be automatic.

One or more embodiments described herein may be implemented using programmatic modules or components. A programmatic module or component may include a program, a subroutine, a portion of a program, or a software or a hardware component capable of performing one or more stated tasks or functions. As used herein, a module or component can exist on a hardware component independently of other modules or components. Alternatively, a module or component can be a shared element or process of other modules, programs or machines.

Furthermore, one or more embodiments described herein may be implemented through instructions that are executable by one or more processors. These instructions may be carried on a computer-readable medium. Machines shown or described with figures below provide examples of processing resources and computer-readable mediums on which instructions for implementing embodiments of the invention can be carried and/or executed. In particular, the numerous machines shown with embodiments of the invention include processor(s) and various forms of memory for holding data and instructions. Examples of computer-readable mediums include permanent memory storage devices, such as hard drives on personal computers or servers. Other examples of computer storage mediums include portable storage units, such as CD or DVD units, flash or solid state memory (such as carried on many cell phones and consumer electronic devices) and magnetic memory. Computers, terminals, network enabled devices (e.g., mobile devices such as cell phones) are all examples of machines and devices that utilize processors, memory, and instructions stored on computer-readable mediums. Additionally, embodiments may be implemented in the form of computer-programs, or a computer usable carrier medium capable of carrying such a program.

System and Device Description

FIG. 1 illustrates a system in which an end-user device is configured to access a network service through the use of a near-field acoustic signal, according to an embodiment. In an example of FIG. 1, system 100 includes an end-user device (e.g., e-reader device 110) that communicates with and utilizes a network service 120 for purpose of receiving, for example, digital content items (e.g., e-books) and other resources. According to some embodiments, system 100 is capable of generating acoustic configuration file 102 which can be played back in proximity to the e-reader device 110 for purpose of configuring the end-user device to access and utilize the network service 120. In some variations, system 100 also includes an intermediate computing device (e.g., mobile computing device 150) that acts as an intermediate device to receive the acoustic configuration file 102 from the network service 120, and to playback the acoustic configuration file 102 in sufficient proximity to the e-reader device 110. Still further, in other variations, the mobile computing device 150 can generate at least a portion of the acoustic configuration file 102 using configuration information obtained on that device.

The network service 120 includes multiple servers and other computing resources that provide various services in connection with one or more applications that are installed on the computing device. By way of example, network service 120 can provide e-book services which communicate with an e-book application on the e-reader device 110. The e-book services provided through network service 120 can, for example, include services in which e-books are sold, shared, downloaded and/or stored.

The e-reader device 110 can correspond to any computing device on which applications and application resources (e.g., e-books, media files, documents) can be rendered and consumed. For example, the e-reader device 110 can correspond to, for example, a tablet, telephony/messaging device (e.g., smart phone) or portable computing device. In one implementation, for example, e-reader device 110 can run an e-reader application that links the device to the network service 120 and enables e-books provided through the service to be viewed and consumed. In another implementation, the e-reader device 110 can run a media playback or streaming application which receives files or streaming data from the network service 120. In examples described herein, the e-reader device 110 also includes an acoustic input component for receiving a sound generated from the playback of the acoustic configuration file 102. The acoustic input component can correspond to a non-specialized, multipurpose microphone.

By way of example, the e-reader device 110 can be equipped with hardware and software to optimize certain application activities, such as reading electronic content (e.g., e-books). For example, the e-reader device 110 can have a tablet like form factor, although variations are possible. In some cases, the e-reader device 110 can also have an E-ink display.

In variations in which the mobile computing device 150 is employed as an intermediate device, the mobile computing device 150 can correspond to, for example, a tablet, handset or telephony/messaging device (e.g., smart phone) or portable computing device. The mobile computing device 150 can include, for example, resources for establishing network connectivity, as well as the ability to receive messages or otherwise communicate with the network service 120. The mobile computing device 150 can be equipped with an acoustic output component to output encoded near-field acoustic signals to the e-reader device 110. In some variations, the acoustic output component can correspond to non-specialized, mufti-purpose speakers typically employed to output music or other audio content.

In additional detail, the network service 120 can include a device interface 128 and an acoustic interface 138. The device interface 128 communicates with individual devices that access the service. Among other resources, the network service 120 can include a resource store 122 and a user account store 124. The user account store 124 can associate the e-reader device 110 with a user and with an account 125. The account 125 can also be associated with one or more application resources (e.g., e-books), which can be stored in the resource store 122. As described further, the user account store 124 can retain metadata for individual accounts 125 to identify resources that have been purchased or made available for consumption for a given account. The e-reader device 110 may be associated with the user account 125, and multiple devices may be associated with the same account. As described in greater detail below, the e-reader device 110 can store resources (e.g., e-books) that are purchased or otherwise made available to the user of the e-reader device 110, as well as to archive e-books and other digital content items that have been purchased for the user account 125, but are not stored on the particular computing device.

The acoustic interface 138 of the network service 120 operates to generate the acoustic configuration file 102 for the e-reader device 110. In one implementation, the device interface 128 obtains an identifier of the e-reader device 110, and identifies an account 125 (if any) that is associated with the identifier. A set of configuration parameters 121 can be obtained for the account 125. The set of configuration parameters 121 can correspond to, for example, the account identifier, login and password for the identified account, and/or payment information associated with the account. In variations, the set of configuration parameters 121 can also include, for example, preferences of the user, settings of the user account or its devices, and/or identification of resources (e.g., e-books) that the user has downloaded or has permission to download. The acoustic interface 138 encodes the set of configuration parameters 121 into acoustic data, and then packages the acoustic data as the acoustic configuration file 102.

In one implementation, configuration parameters can be embedded as an in-audio frequency range (10 Hz<fs<22.05 kHz) such as at approximately 18 kHz. In a variation, the configuration parameters can be embedded as an out-of-band frequency range (100 kHz>fs>22.05 kHz). The acoustic configuration file can further include audio content, such as music or voice (e.g., message or instruction). When the acoustic configuration file 102 includes audio content provided in an out-of-band range, the configuration parameters can be communicated without additional audio noise that would interfere with human listening of the audio configuration file.

Multiple kinds of encoding techniques can be employed in order to embed information such as configuration parameters in the acoustic configuration file. In particular, the configuration parameters can be encoded as audio data using a spread spectrum technique and/or an electrical water marking technique. For example, in one implementation, a modulation technique such as provided by orthogonal frequency-division multiplexing (OFDM) can be used. In variations, the encoding scheme can be provided by a digital water marking technique, including techniques that employ Data Encryption Standard ("DES") as well as Rivest, Shamir, Adleman ("RSA") encoding.

The network service 120 can store the acoustic configuration file 102 (e.g., linked with the user account 125), or alternatively store and/or transport the acoustic configuration file 102 to a designated destination. For example, once the acoustic configuration file 102 is generated, the file can be messaged or otherwise communicated to an email address or other network location associated with the account 125 of the e-reader device 110.

Once transported, the acoustic configuration file 102 can be played back in proximity to the e-reader device 110 for purpose of configuring that device. In particular, the e-reader device 110 can be configured to utilize the set of configuration parameters 121 to, for example, access and utilize the network service 120. For example, as described in greater detail below, the e-reader device 110 can process acoustic signals received from the playback of the acoustic configuration file 102 in order to detect and process the set of configuration parameters 121. Once configured, the e-reader device 110 can utilize the set of configuration parameters 121 to access and utilize the network service 120.

According to some embodiments, the acoustic configuration file can be provided in the form of a music file or a voice file. In this way, the user can listen to audio content when outputting the acoustic configuration file on the mobile computing device 150. This allows for the user to listen to music or a voice message (e.g., notification message from the network service 120), while the acoustic signal output is further detected by the e-book device 110 and processed for configuration parameters.

In variations, the configuration parameters 121 can be provided to the e-reader device 110 for purpose of, for example, triggering the e-reader device 110 to perform diagnostics or corrective processes (e.g., de-bugging). As another variation, data sets and programmatic code can be signaled to the e-reader device 110 to facilitate diagnostic or corrective processes.

According to one aspect, the e-reader device 110 includes programmatic logic corresponding to a service interface 108 and an acoustic interface 118. The service interface 108 can communicate and link that device with the network service 120. The acoustic interface 118 can process acoustic signals received through the microphone of the e-reader device 110 for purpose of detecting information items that are embedded in the acoustic signal. In the example of FIG. 1, the e-reader device 110 identifies information items corresponding to the configuration parameters 121. The service interface 108 can utilize the configuration parameters 121 in order to link or otherwise connect the e-reader device 110 to the network service 120. By way of example, the configuration parameters 121 can enable the service interface 108 of the end-user device 110 to programmatically specify an account identifier, login, password and/or other parameter when communicating with and accessing the network service 120.

In some variations, the mobile computing device 150 serves as an intermediate device that receives the acoustic configuration file 102, and then play back the acoustic configuration file 102 in proximity to the e-reader device 110. In one implementation, the mobile computing device 150 can include a service interface 168 for communicating with the network service 120. The mobile computing device 150 can receive the acoustic configuration file 102 from the network service 120 via the service interface 168. In variations, the acoustic configuration file 102 can be received through a messaging interface, such as an e-mail program installed on the mobile computing device 150. Once the acoustic configuration file 102 is received, playback of the acoustic configuration file 102 can be initiated by the user. The mobile computing device 150 can be positioned in sufficient proximity to the e-reader device 110 so that the resulting acoustic signal is detectable by the microphone of the e-reader device 110.

In some embodiments, the mobile computing device 150 can generate additional acoustic data for inclusion in the acoustic configuration file 102. In one implementation, the mobile computing device 150 includes an acoustic interface 158. The mobile computing device 150 can operate to obtain additional information items for purpose of configuring the e-reader device 110, and then the acoustic interface 158 generates additional acoustic data that encodes the determined information. The mobile computing device 150 can determine the additional information items from the network service 120, using for example, network service interface 168. As an addition or variation, the mobile computing device 150 can determine the additional information items from user input. Still further, the mobile computing device 150 can implement processes to programmatically determine information items regarding, for example, local computing environment parameters (e.g. network settings) and other information. In this way, the mobile computing device 150 can utilize the acoustic interface 158 to append or augment the acoustic configuration file 102 with additional acoustic data determined on the mobile computing device 150.

Still further, while an example of FIG. 1 illustrates an embodiment in which the acoustic configuration file 102 is generated by the network service 120, variations provide that the mobile computing device 150 serves as the source (or partial source) for the acoustic configuration file 102. Specifically, the mobile computing device 150 may store information items corresponding to configuration parameters needed by the e-reader device 110 for purpose of accessing the network service 120. For example, the mobile computing device 150 can be linked to the same account as the e-reader device 110, thus having the same login and password credentials required for accessing the network service 120. This information can be incorporated into the acoustic configuration file 102. Still further, the mobile computing device 150 can perform steps to retrieve information items from different sources. For example, the mobile computing device 150 can retrieve information items corresponding to configuration parameters 121 from the network service 120 using the service interface 168. Additionally, the mobile computing device 150 can obtain information items from user input, or from programmatic processes that detect various kinds of information items, such as network settings. Once the information items are determined, the mobile computing device 150 can generate the acoustic configuration file 102 for output to the e-reader device 110.

Hardware Description

Figure 2:
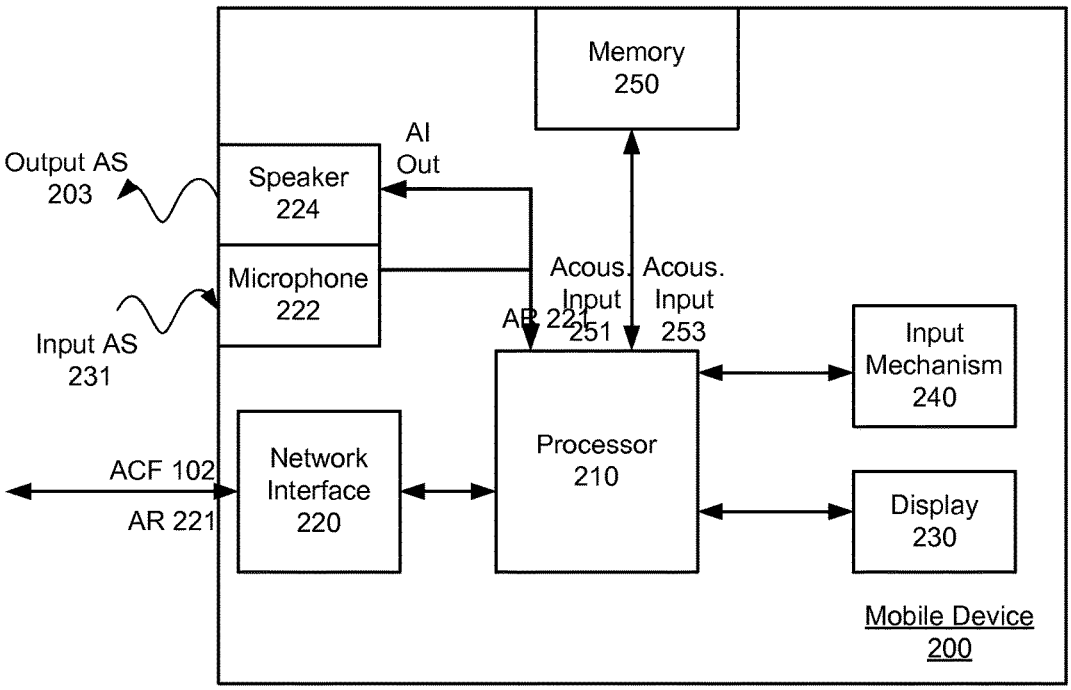
FIG. 2 illustrates an example of an intermediate computing device for use with one or more embodiments described herein.

FIG. 2 illustrates an example of an intermediate computing device for use with one or more embodiments described herein. In an example of FIG. 2, the intermediate computing device can correspond to, for example, a mobile computing device, such as also shown by an example of FIG. 1. With reference to FIG. 2, mobile computing device 200 includes a processor 210, a network interface 220, a display 230, one or more input mechanisms 240, and a memory 250. The mobile computing device 200 can also include a microphone 222 and a speaker 224. Each of the microphone 222 or speaker 224 can correspond to a non-specialized, multipurpose component. For example, each of the microphone 222 or speaker 224 can be an "off-the-shelf" component that is manufactured to receive or output sound in a wide variety of acoustic spectrums, including those used to input/output music and/or voice.

In some implementations, the processor 210 utilizes the network interface 220 to communicate with the network service 120 (see FIG. 1). More specifically, the mobile computing device 200 can access the network service 120 to receive various kinds of resources (e.g., digital content items such as e-books, configuration files, account information), as well as to provide information (e.g., user account information, service requests etc.). For example, mobile computing device 200 can receive application resources 221, such as e-books or media files, that the user elects to purchase or otherwise download from the network service 120. The application resources 221 that are downloaded onto the mobile computing device 200 may be stored in the memory 250.

In some implementations, the display 230 can correspond to, for example, a liquid crystal display (LCD) or light emitting diode (LED) display that illuminates in order to provide content generated from processor 210. In some variations, the display 230 can be touch-sensitive.

According to some embodiments, the memory 250 stores instructions corresponding to logic for generating encoded acoustic output 253. As an intermediate device, the mobile computing device 200 can receive acoustic configuration file 102 from, for example, network service 120. The processor 210 can playback the acoustic configuration file 102 received through the network interface 220 (e.g., by email) to generate an output acoustic signal 203. The playback of the acoustic configuration file 102 can be performed in sufficient proximity to the end-user device 110 to enable detection of the acoustic signal 203 through the microphone of the end-user device 110.

Some variations provide for the processor 210 to utilize the acoustic output logic 253 to generate an encoded acoustic signal that contains information items that are obtained on the mobile computing device 150. The information items can be determined, for example, from the network service 120, or alternatively from the user providing input to the input mechanism 240 (e.g., user provides password or login information etc.). Additionally, some configuration parameters or information items can be programmatically determined from resources of the mobile computing device 200. By way of example, the programmatically determined information items can include local network settings, which any computing device may need in order to obtain network connectivity from within that local network. The determined information items can be encoded into output acoustic signal 203 using the acoustic output logic 253. As described with an example of FIG. 1, the mobile computing device 200 can be positioned in proximity to the e-reader device 110, so that the output acoustic signal 203 can be communicated from the speaker 224 and detected by a microphone of the e-reader device.

Additionally, in some variations, the mobile computing device 200 can receive an input acoustic signal 231 from the e-reader device 110 via the microphone 222. The e-reader device 200 can store the acoustic input signal 231 as a file in the memory 250, for purpose of communicating it to another computer or location (e.g., network service 120). In some variations, the processor 210 can implement acoustic interpretation logic to interpret the input acoustic signal 231. In such implementations, the processor 210 can store, for example, a data file or set in the memory 250 that represents decoded information determined from the input acoustic signal 231.

Acoustic Interface for Intermediate Device

Figure 3:
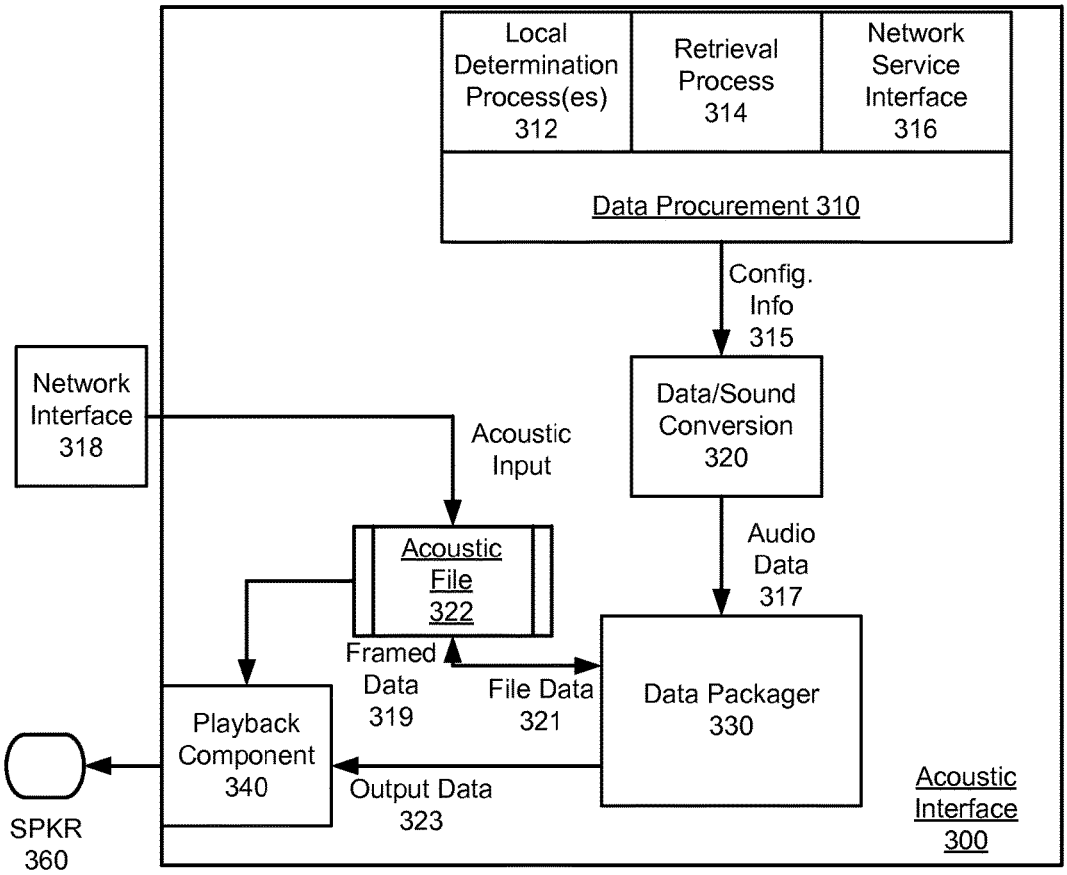
FIG. 3 illustrates an embodiment in which an acoustic interface can be implemented by an intermediate device for purpose of generating an acoustic output signal that configures the end-user device, according to an embodiment.

FIG. 3 illustrates an embodiment in which an acoustic interface can be implemented by an intermediate device for purpose of generating an acoustic output signal that configures the end-user device. With reference to an example of FIG. 1, the acoustic interface 300 can be implemented by the mobile computing device 150 (see e.g., acoustic interface 158). Accordingly, reference may be made to elements of FIG. 1 for purpose of illustrating in operational environment of the acoustic interface 300.

In an embodiment, the acoustic interface 300 includes a data procurement subsystem 310, a data/sound conversion component 320, a data packager 330, and a playback component 340. The data procurement subsystem 310 provides processes for obtaining various kinds of information, such as account information with the network service, local computing environment information, and/or user preferences. In more detail, the data procurement subsystem 310 can include one or more components corresponding to a local determination process (or processes) 312, a retrieval process 314, and a network service interface 316. In this way, data procurement subsystem 310 can obtain configuration information 315 from one or more sources, including from local and/or network resources, depending on implementation.

The local determination process 312 can include one or more processes that determine information from the user and/or the local operating or network environment. For example, the local determination process 312 can obtain network settings for a local network given a particular environment at a given instance. The network settings can include, for example, the identifier the local network (e.g. SSID) and/or the encryption key or password for accessing the local network. The local determination process 312 can also implement prompts to trigger the user into entering information, such as account information for network service 120 (login and password etc.), payment information for purchasing resources from the network service 120), network settings, and/or other information such as preferences (e.g., desired device settings for the end-user device 110).

The retrieval process 314 can implement processes to retrieve account information from various account sources, including the network service 120, or alternatively other network services or websites. For example, the user can provide input (e.g., through local determination process 312) to specify a desired website and account information maintained for such websites. In one implementation, the retrieval process 314 can access network service 120 to retrieve account information and other information items maintained with the account 125 associated with the end-user device 110. This information can include the login and password, as well as for example, user preferences or other information. In a variation, the retrieval process 314 can utilize locally implemented interface processes 316, such as provided by a locally installed application, in order to obtain information items and other configuration parameters for accessing network service 120. For example, with reference to FIG. 1, the mobile computing device 150 can execute an application that links that device to the network service 120. The locally implemented interface process 316 can access such an application in order to determine configuration parameters for accessing network service 120.

The data procurement subsystem 310 can provide configuration information 315 to the data/sound conversion component 320. The data/sound conversion component 320 converts configuration information 315 into audio data 317, in accordance with an encoding scheme such as provided by OFDM or spread spectrum. In one implementation, the data/sound conversion component 320 generates frames of data that represent bytes of information corresponding to the configuration information 315. The audio data 317 can be encoded so as to represent the configuration information 315, and more specifically configuration parameters identified from the account information.

The data packager 330 processes the audio data 317 in order to package data 319. In particular, the packaged acoustic data 319 can be structured according to a predetermined format and protocol so that individual frames embedded in the acoustic signal carry bits of information. The data packager can optionally incorporate content, such as voice content or music with the packaged data 319. The acoustic configuration file 322 can be generated and/or maintained using the packaged acoustic data 319.

The playback component 340 can playback data from the acoustic configuration file 322. In particular, the playback component 340 can output an acoustic signal through the speaker 360 of the intermediate computing device such as shown by mobile computing device 150 in FIG. 1. In one implementation, playback component 340 generates an inaudible acoustic signal (e.g., at approximately 22.05 kHz or more) using data from the acoustic configuration file 322. When the speaker 360 is positioned in near proximity to the end-user device, the acoustic signal output from the speaker can be detected and processed in order to determine configuration parameters corresponding to the configuration information 315.

In some implementations, the mobile computing device 150 receives the acoustic configuration file 322 from, for example, network service 120. For example, a network interface 318 of the intermediate computing device can receive and store the acoustic configuration file 322. The mobile computing device 150 can append or reconfigure the acoustic configuration file 322 using information locally obtained on the intermediate computing device. For example, one or more local determination processes 312 can obtain local network settings that are necessary for e-reader device 110 to achieve connectivity with network service 120.

In one implementation, audio data 317 corresponding to such configuration information 315 is appended or stitched onto an existing acoustic configuration file 322 (e.g., one that is received from the network service 120). The data packager 330 can analyze the data stream of the acoustic configuration file 322 to identify individual frames corresponding to bytes of information. When additional configuration data 315 is obtained by the mobile computing device 150, the data/sound conversion component generates the corresponding acoustic data 317. The data packager 330 can splice or append the data frames corresponding to the acoustic data 317 of the additional configuration information 315 onto the existing stream of the configuration file 322. In this way, the network service 120 can provide an acoustic configuration file 322 that includes some of the configuration parameters necessary for the end-user device 110 to access the network service. Another portion of the configuration parameters for the e-reader device 110 can be obtained locally by the mobile computing device 150 executing processes that obtain, for example, parameters for the local computing environment.

In variations, the mobile computing device 150 (acting as the intermediate device) can also obtain configuration parameters using (i) user input received from the user (e.g., user enters login and password), or (ii) from accessing the network service 120 through an independent connection. Such additional configuration parameters can also be stitched or appended onto the existing acoustic configuration file 322.

Methodology

Figure 4:
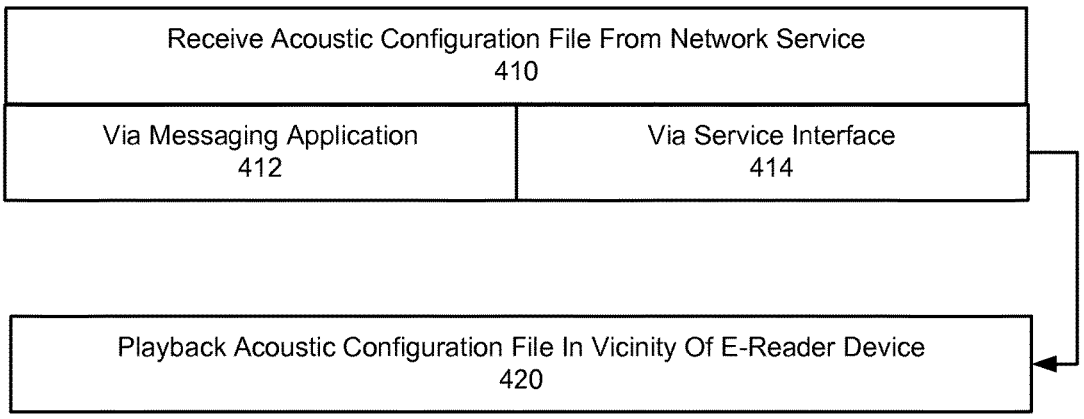
FIG. 4 illustrates a method for using an intermediate device to receive an acoustic configuration file and to playback the acoustic configuration file to an end-user device, according to an embodiment.
Figure 5:
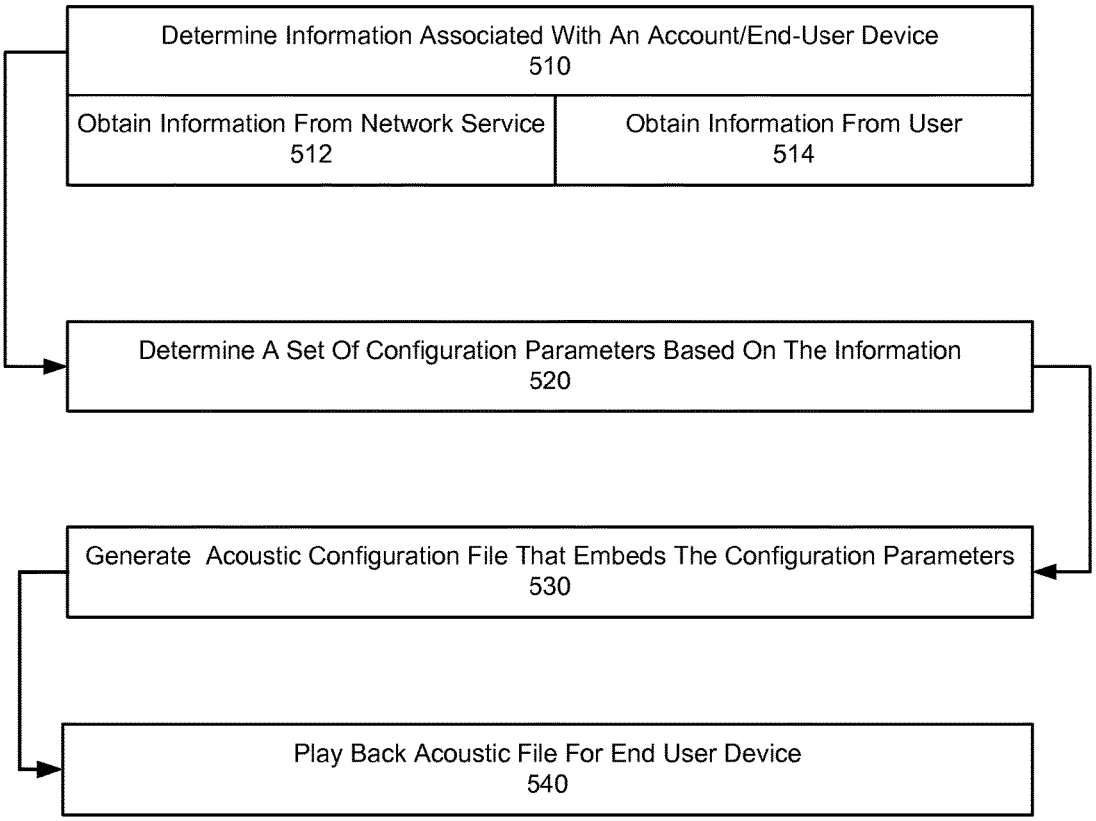
FIG. 5 illustrates a method for an intermediate device to incorporate determined configuration parameters into an acoustic configuration file for playback to an end-user device, according to an embodiment.
Figure 6:
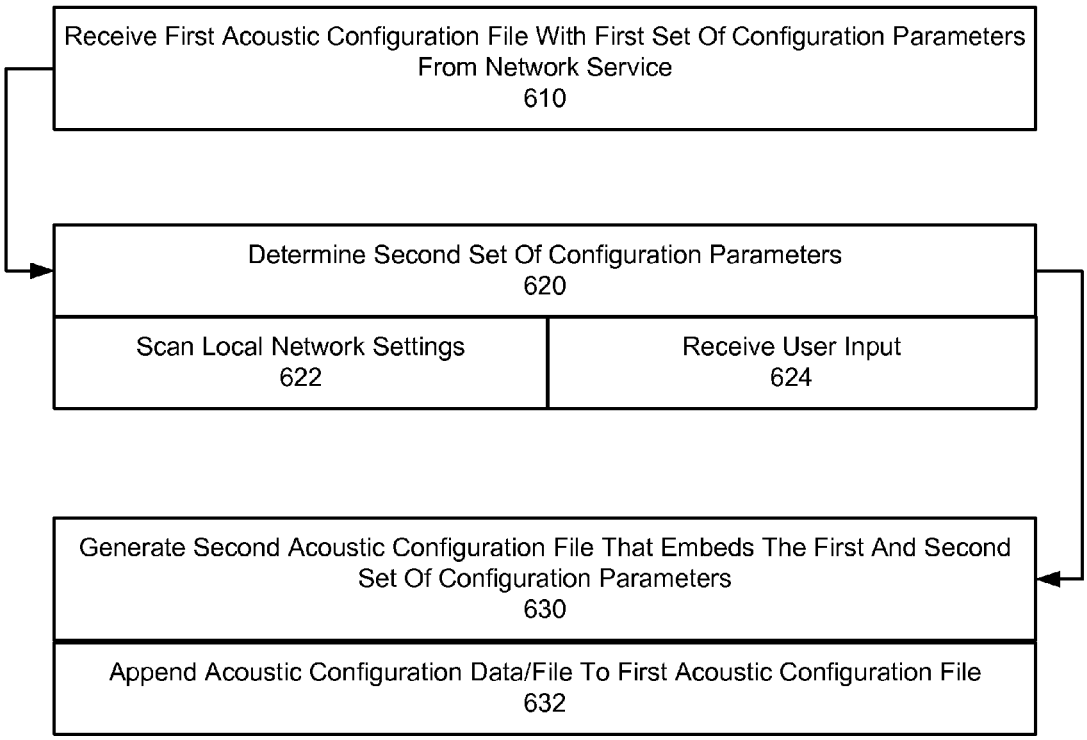
FIG. 6 illustrates a method for an intermediate device to receive an acoustic configuration file from a network service and to append or augment the acoustic configuration file for playback to an end-user device, according to an embodiment.

FIG. 4 illustrates a method for using an intermediate device (e.g., mobile computing device 150) to receive an acoustic configuration file and to playback the acoustic configuration file to an end-user device (e.g., e-reader device 110). FIG. 5 illustrates a method for an intermediate device (e.g., mobile computing device 150) to obtain configuration parameters and to incorporate determined configuration parameters into an acoustic configuration file for playback to an end-user device (e.g., e-reader device 110). FIG. 6 illustrates a method for an intermediate device to receive an acoustic configuration file from a network service and to append or augment the acoustic configuration file for playback to an end-user device (e.g., e-reader device 110). Examples such as described with FIG. 4 through FIG. 6 may be implemented using components such as described with FIG. 1 through FIG. 5. Accordingly, reference may be made to elements of FIG. 1, for example, for purpose of illustrating suitable components for performing a step or sub-step being described.

With reference to an example of FIG. 4, the mobile computing device 150 receives an acoustic configuration file 102 from the network service 120 (410). In one implementation, the mobile computing device 150 is used to open an e-mail or other message containing an attachment corresponding to the acoustic configuration file 102 (412). In a variation, the mobile computing device 150 can operate an application or other interface that enables it to communicate directly with a network service 120. The mobile computing device 150 can receive the acoustic configuration file 102 from the network service using such an interface (414).

The mobile computing device 150 can playback acoustic configuration file 102 in the vicinity of the e-reader device (420). The proximity of the mobile computing device 150 to the e-reader device 110 can be determined from the characteristics of the resulting acoustic signal generated from the acoustic configuration file 102. In one implementation, the acoustic signal is at an inaudible frequency (e.g., between 22.05 kHz and 100 kHz), but detectable through standard microphones. The vicinity between the mobile computing device 150 and the e-reader device 110 can be based in part on the amplitude of the acoustic signal, as well as a selected frequency and the level of ambient noise present. In one implementation, the mobile computing device 150 is positioned within 10 feet of the microphone of the e-reader device 110. In variations, the mobile computing device 150 is positioned within a foot, and more particularly, within a few inches of the microphone for the e-reader device 110, in order for the acoustic signal from the playback of the acoustic configuration file 102 to be detectable.

With reference to an example of FIG. 5, the mobile computing device 150 (acting as an intermediate device) determines information associated with an account or end-user device (e.g., e-reader device 110) (510). The mobile computing device 150 can determine information from multiple sources. In one implementation, the mobile computing device 150 can obtain information from the network service 120 (512). For example, the mobile computing device 150 can be associated with an account that is to be linked with the e-reader device 110. The mobile computing device 150 can access the network service 120 to determine account information, particularly information items that are relevant for the e-reader device 110. As a variation, the mobile computing device 150 can determine information from the user (514). For example, the mobile computing device 150 can prompt the user to enter information items, such as information relating to network settings, device preferences, library settings, and account information for network service 120.

A set of configuration parameters can be determined based on the information (520). In particular, information items provided by the user can be parsed, then formatted and/or structured to have a form that is usable by a relevant programmatic entity or interface.

The mobile computing device 150 can generate an acoustic configuration file 102 that embeds the configuration parameters (530). For example, the acoustic configuration file 102 can embed (i) password and login information for accessing network service 120, (ii) preferred or desired device settings, and/or (iii) other information as obtained from one or more sources (e.g., network service, user) available to the mobile computing device 150. Once the acoustic configuration file 102 is determined, the mobile computing device 150 is able to play back the acoustic configuration file in the vicinity of the e-reader device 110 (540).

With reference to an example of FIG. 6, an embodiment provides that the intermediate device (e.g., mobile computing device 150) receives a first acoustic configuration file from the network service 120 (610). The first acoustic configuration file 102 can include a first set of configuration parameters. For example, the first set of configuration parameters can relate to parameters that the e-reader device may need to utilize in order to access the network service 120.

The mobile computing device 150 can also determine a second set of configuration parameters (620). The second set of configuration parameters can be determined from local processes and resources of the mobile computing device 150. For example, in one implementation, the mobile computing device 150 can determine settings for accessing and utilizing a local network (622). As another example, the mobile computing device 150 can issue a series of prompts that triggers the user into entering various kinds of input, such as credit card information, device preferences, etc (624).

The mobile computing device 150 can generate a second acoustic configuration file that embeds both the first and second set of configuration parameters (630). In one embodiment, the mobile computing device 150 processes the first acoustic configuration file 102 to determine the first set of configuration parameters, then generates the second acoustic configuration file to replace the first acoustic configuration file.

As a variation, the mobile computing device 150 can generate an acoustic configuration file for the second set of configuration parameters, then append or stitch the second acoustic configuration file to the first acoustic configuration file. For example, the data stream of the first acoustic configuration file can be analyzed to identify data frames representing information items. The frames for the acoustic data of the second configuration file can be stitched at the end of, or in between the frames of the first acoustic configuration file.

Usage Examples

Embodiments recognize that on occasion, the purchase of a new device (e.g., e-reader device 110) can be a problematic phase with regards to establishing such devices for ongoing use for a particular user. With regard to the e-reader devices, for example, such devices are often linked to the network service from which e-books can be downloaded. Moreover, the functionality of such devices is significantly limited if the device cannot access the network service from where e-books (or other digital content items) can be downloaded or purchased. Thus, for example, the inability of the user to establish network connectivity, or establish a new account can significantly hinder the user's out-of-box enjoyment of the new device. Conversely, when such users seek help, conventional approaches can sometimes be problematic. If the user is unable to access a network and/or is unable to access a necessary network service, the ability of the manufacturer or provider to remotely troubleshoot the device is also limited.

Among other benefits, examples described herein, on the other hand, enable users to perform configuration processes to achieve network connectivity and/or access to the network service using resources that are typically available to any user. Additionally, the acts required of the user can be significantly simpler to perform than more conventional approaches. Under conventional approaches, for example, the user sometimes has to enter various network settings and/or account information when the user may have little familiarity with what is needed.

In some embodiments, the user can place a phone call to the help center (e.g., technical assistance line), then provide the help center with an e-mail address. The help center can determine configuration parameters for the user end-device, and then programmatically generate the acoustic configuration file 102 and send the acoustic configuration file to the user as an email. The user can select an intermediate device to access the email and to playback the acoustic configuration file 102. For example, the user can place the microphone of the e-reader device 110 adjacent to (or near) the speaker of the mobile computing device 150. The mobile computing device 150 can then playback the attachment in order to generate the acoustic signal for the e-reader device 110. Upon receiving the acoustic transmission, the e-reader device 110 can configure itself with necessary information such as network service login and password, so that the user is able to access the network service.

Additionally, in some variations, the e-reader device 110 can implement diagnostic or corrective processes in order to assist the help center with troubleshooting. For example, the mobile computing device 150 can output an acoustic signal that provides a data set to trigger the e-reader to execute a diagnostic process. Furthermore, the e-reader device 110 can return an acoustic response that can be communicated through the telephonic channel to the network service 120. The acoustic transmission returned from the e-reader device 110 can include information relating to the result of the diagnostic or corrective process. In this way, the e-reader device 110 can be configured, diagnosed, or corrected with transmission of acoustic signals.

As another illustration, rather than generate the acoustic transmission from the network service 120, the network service 120 can package the acoustic configuration file 102 as an attachment to a message. The message can be communicated to an email address provided by the user. The user can operate an intermediate device, such as their mobile handset (e.g., mobile computing device 150), to output the acoustic configuration file 102 in proximity to the e-reader device 110. In turn, the e-reader device 110 can configure itself with configuration parameters and other information items embedded in the acoustic transmission.

Alternatives or Variations

As an alternative or variation, an audio configuration file such as described with various examples herein can be provided in the form of a media file. Thus, for example, audio-visual content can include acoustic configuration parameters that are detectable to, for example, an end-device. A user can playback the media file to receive audio/video content on, for example, the mobile computing device 150, while at the same time, the user can have the e-reader device detect and process configuration parameters in the detectable audio signal. As mentioned in some other examples, the encoding of the audio signal can use either in-audio-range or out-of-audio range frequencies.

In variations, the mobile computing device 150 can output video content that includes visual encoding. For example, the display of the mobile computing device 150 can output visual encoding, and a camera component of the e-reader device can detect codes embedded in the visual output. The visual encoding scheme can utilize, for example, still images, moving pictures, or QR codes. In particular, the camera can detect visual information that can be processed for configuration parameters.

Although illustrative embodiments have been described in detail herein with reference to the accompanying drawings, variations to specific embodiments and details are encompassed by this disclosure. It is intended that the scope of embodiments described herein be defined by claims and their equivalents. Furthermore, it is contemplated that a particular feature described, either individually or as part of an embodiment, can be combined with other individually described features, or parts of other embodiments. Thus, absence of describing combinations should not preclude the inventor(s) from claiming rights to such combinations.

What is claimed is:

1. A method for operating an intermediate computing device to configure an end-user device, the method being implemented by one or more processors of the intermediate computing device and comprising:

accessing, using the intermediate computing device, a network service to determine account information of the end-user device;

determining, using the intermediate computing device, a set of configuration parameters based on the determined account information of the end-user device;

generating at least a portion of an acoustic configuration file that embeds the configuration parameters; and playing back the acoustic configuration file to generate an acoustic signal that conveys the configuration parameters to the end-user device, wherein the generating at least a portion of the acoustic configuration file includes: receiving a first acoustic configuration file from a network server, the first acoustic configuration file including a first set of configuration parameters;

determining, on the intermediate computing device, a second set of configuration parameters; and generating a second acoustic configuration file that includes the first acoustic configuration file, the second acoustic configuration file including the first set of configuration parameters and the second set of configuration parameters.

2. The method of claim 1, wherein playing back the acoustic configuration file includes generating the acoustic signal to include acoustic characteristics that require a microphone of the end-user device to be within sufficient proximity of a speaker of the intermediate computing device.

3. The method of claim 2, wherein the acoustic characteristics require the microphone of the end-user device to be within ten feet of the speaker of the intermediate computing device.

4. The method of claim 1, wherein determining account information of the end-user device includes: communicating an identifier to a network service; and retrieving, from the network service, one or more information items associated w the account.

5. Tire method of claim 1, wherein determining account information of the end-user device includes prompting a user to enter least some of the information through an interface of the intermediate computing device.

6. The method of claim 1, further comprising programmatically detecting network parameters for enabling the end-user device to communicate with a network service, and wherein generating at least the portion of the acoustic configuration file includes embedding the network parameters into the acoustic configuration file.

7. The method of claim 6, wherein the network parameters include (i) an identifier of a local network, and (ii) information needed to access and use the local network.

8. The method of claim 1, wherein generating the second acoustic configuration file includes generating acoustic data that corresponds to the second set of configuration parameters, and then combining acoustic data of the first acoustic configuration file with the acoustic data of the second acoustic configuration file.

9. The method of claim 1, wherein determining the second set of configuration parameters includes programmatically determining a local network parameter for use in accessing the network service.

10. The method of claim 9, wherein the local network parameter includes an identifier of a local network that the intermediate device is connected to, and a network key for accessing the local network.

11. The method of claim 1, wherein determining the second set of configuration parameters includes receiving user input identifying a setting.

12. The method of claim 1, wherein generating the second acoustic configuration file includes appending acoustic data that embeds the second set of configuration parameters to the first acoustic configuration file.

13. The method of claim 1, wherein generating at least the portion of an acoustic configuration file includes incorporating audio content into the acoustic configuration file, the audio content corresponding to at least one of music or voice message, and wherein playing back the acoustic configuration file includes playing back the audio content while acoustically transmitting the configuration parameters to the end-user device.

14. The method of claim 1, wherein generating at least the portion of the acoustic configuration file includes encoding the configuration parameters using a spread spectrum technique and/or an electrical water marking technique.

15. A method for operating an intermediate computing device to configure an end-user device, the method being implemented by one or more processors of the intermediate computing device and comprising:

accessing, using the intermediate computing device, a network service to determine account information of the end-user device;

receiving a first acoustic configuration file from the network service, the first acoustic configuration file including a first set of configuration parameters;

determining, using the intermediate computing device, a second set of configuration parameters based on the determined account information of the end-user device; and generating a second acoustic configuration file that includes the first acoustic configuration file, the second acoustic configuration file including the first set of configuration parameters and the second set of configuration parameters.

16. The method of claim 15, generating the second acoustic configuration file includes generating acoustic data that corresponds to the second set of configuration parameters, and then combining acoustic data of the first acoustic configuration file with the acoustic data that corresponds to the second set of configuration parameters.

17. The method of claim 15, wherein determining the second set of configuration parameters includes determining a local network parameter for use in accessing the network service.

18. The method of claim 15, wherein determining the second set of configuration parameters includes receiving user input identifying a setting.

19. The method of claim 17, wherein the local network parameter includes an identifier of a local network that the intermediate device is connected to, and a network key for accessing the local network.

20. The method of claim 15, wherein generating the second acoustic configuration file includes appending acoustic data that embeds the second set of configuration parameters to the first acoustic configuration file.

21. A computing device comprising:

a memory that store a set of instructions; and processing circuitry configured to:

access a network service to determine account information of an end-user device;

determine a set of configuration parameters based on the determined information based on the determined account information of the end-user device;

generate at least a portion of an acoustic configuration file that embeds the configuration parameters; and playback back the acoustic configuration file to generate an acoustic signal that conveys the configuration parameters to the end-user device, wherein the generating at least a portion of the acoustic configuration file by the processing circuitry includes receiving a first acoustic configuration file from a network service, the first acoustic configuration file including a first set of configuration parameters;

determining a second set of configuration parameters; and generating a second acoustic configuration file that includes the first acoustic configuration file, the second acoustic configuration file including the first of configuration parameters and the second set of configuration parameters.

22. The method of claim 1, wherein the set of configuration parameters includes password and login information of the determined account information of the end-user device for accessing the network service.

23. The method of claim 1, wherein the set of configuration parameters includes local network setting information of the end-user device and the intermediate computing device.

* * * * *